US005295943A

United States Patent [19]

Romanauskas et al.

[11] Patent Number: 5,295,943

[45] Date of Patent: Mar. 22, 1994

[54] ADAPTER FOR HOLDING A PAIR OF CENTRIFUGE TUBES

[75] Inventors: William A. Romanauskas; Edward T. Sheeran, Jr., both of Southbury, Conn.

[73] Assignee: E. I. Du Pont de Nemours and Company, Wilmington, Del.

[21] Appl. No.: 68,497

[22] Filed: May 27, 1993

Related U.S. Application Data

[63] Continuation-in-part of Ser. No. 35,513, Mar. 22, 1993, which is a continuation of Ser. No. 695,871, May 6, 1991, which is a continuation-in-part of Ser. No. 552,631, Jul. 13, 1990, abandoned, which is a continuation-in-part of Ser. No. 432,646, Nov. 7, 1989, abandoned.

[51] Int. Cl.[5] ..... B04B 15/00

[52] U.S. Cl. ..... 494/16; 494/45

[58] Field of Search ..... 494/16, 17, 18, 19, 494/20, 37, 45, 85; 422/72, 99, 100

[56] References Cited

U.S. PATENT DOCUMENTS

| | | | |
|---|---|---|---|
| 3,050,239 | 8/1962 | Williams | 233/24 |
| 3,674,197 | 7/1972 | Mitchell et al. | 233/14 R |
| 3,674,198 | 7/1972 | Eberle | 233/26 |
| 3,891,140 | 6/1975 | Ayres | 233/26 |
| 3,905,772 | 9/1975 | Hartnett et al. | 23/259 |
| 3,998,383 | 12/1976 | Romanauskas et al. | 233/26 |
| 4,015,775 | 4/1977 | Rohde | 233/26 |
| 4,032,066 | 6/1977 | Wright | 233/26 |
| 4,141,489 | 2/1979 | Wright | 233/26 |
| 4,290,550 | 9/1981 | Chulay et al. | 233/26 |
| 4,304,356 | 12/1981 | Chulay et al. | 233/26 |
| 4,306,676 | 12/1981 | Edwards et al. | 233/26 |
| 4,360,150 | 11/1982 | Ishimaru et al. | 233/26 |
| 4,375,272 | 3/1983 | Sutton, III | 494/16 |
| 4,511,349 | 4/1985 | Nielsen et al. | 494/16 |
| 4,552,278 | 11/1985 | Romanauskas | 215/277 |
| 4,692,137 | 9/1987 | Anthony | 494/85 |
| 5,024,646 | 6/1991 | Lewis | 494/16 |
| 5,158,749 | 10/1992 | Eberle | 422/102 |

OTHER PUBLICATIONS

PCT Published Application WO 91/06373, published May 16, 1991.

*Primary Examiner*—Robert W. Jenkins

[57] ABSTRACT

An adapter for a centrifuge tube comprises two adapter segments, each of which has an exterior surface and a mating surface thereon. Each segment has a pair of indentations in the mating surface. When the segments are joined along their mating surfaces the indentations cooperate to define a pair of recesses therein. Each recess so defined is configured to surround totally a centrifuge tube disposed therein. Each recess has an axis extending therethrough, with the axes of the recesses being collinear. The collinear axes of the recesses are aligned parallel to the axis of rotation of the rotor, and preferably also align collinearly with the axis of the rotor cavity in which the adapter is disposed. Each adapter segment is fabricated of a material that has sufficient strength to withstand the vertical forces created by the pressure of a liquid under centrifugation. At least one of the adapter segments has an effective weight sufficient to balance forces created by the pressure of a liquid carried in the tubes under centrifugation that act transversely to the central axis.

1 Claim, 1 Drawing Sheet

ADAPTER FOR HOLDING A PAIR OF CENTRIFUGE TUBES

CROSS REFERENCE TO RELATED APPLICATIONS

This application is a continuation-in-part of application Ser. No. 08/035,513, filed Mar. 22, 1993, which is itself a continuation of application Ser. No. 07/695,871, filed May 6, 1991, which is itself a a continuation-in-part of application Ser. No. 07/552,631, filed Jul. 13, 1990, now abandoned, which is itself a continuation-in-part of application Ser. No. 07/432,646, filed Nov. 7, 1989, now abandoned, all in the names of Romanauskas and Sheeran and all assigned to the assignee of the present invention.

Subject matter disclosed herein is claimed in copending application titled "Adapter For Centrifuge Tube", Ser. No. 08/068,498, filed contemporaneously herewith the names of Hall, Sheeran and Sullivan.

BACKGROUND OF THE INVENTION

1. Field of the Invention

The present invention relates to an adapter for holding a pair of centrifuge tubes in a centrifuge rotor cavity, and in particular, to an adapter having two segments which, upon mating, cooperate to define a pair of tube-receiving recesses.

2. Description of the Prior Art

PCT publication WO 91/06373 discloses an adapter for supporting a sealed centrifuge tube within a cavity of a centrifuge rotor. The adapter comprises a pair of matable adapter segments, each of which has an indentation therein. When the segments are joined along mating surfaces the indentation in each segment cooperate to define a recess having a size and shape that (within a certain range of manufacturing tolerances) closely corresponds to the size and shape of some portion or all of the sealed centrifuge tube. U.S. Pat. No. 3,674,197 (Mitchell et al.), assigned to the assignee hereof and U.S. Pat. No. 4,692,137 (Anthony) are each exemplary of an adapter formed from two segments.

In some instances it may be desirable to increase the number of sealed tubes that a given rotor can carry. U.S. Pat. Nos. 4,306,676 (Edwards) and 4,360,150 (Ishimaru et al.) are each directed to an arrangement facilitating the accommodation of two or more containers within a single cavity of a vertical angle centrifuge rotor. U.S. Pat. Nos. 3,050,239 (Williams); 3,674,198 (Eberle); 3,891,140 (Ayres); 3,905,772 (Hartnett); 4,032,066 (Wright); and 4,141,489 (Wright) each discloses an adapter arrangement which carries plural tubes in a swinging bucket centrifuge rotor.

SUMMARY OF THE INVENTION

The present invention is directed to an adapter for supporting a pair of closed centrifuge tubes each having a predetermined size and configuration within a single cavity in a vertical angle centrifuge rotor. The rotor is rotatable to a predetermined maximum speed. The adapter has a central axis extending therethrough that, in use, aligns in parallel relationship both with the axis of the rotor cavity in which the adapter is disposed and, thus, with the axis of rotation of the vertical angle rotor.

The adapter comprises a first and a second adapter segment, each of which has an exterior surface and a mating surface thereon. Each segment has a pair of indentations in the mating surface thereof. The indentations are shaped such that when the segments are joined along their mating surfaces the indentations cooperate to define a pair of recesses therein. Each recess is configured to surround totally a centrifuge tube disposed therein. Each recess has an axis extending therethrough, with the axes of the recesses being collinear. The collinear axes of the recesses are aligned parallel to the axis of rotation of the rotor, and preferably also align collinearly with the axis of the rotor cavity in which the adapter is disposed.

Each adapter segment is fabricated of a material that has sufficient strength to withstand the vertical forces created by the pressure of a liquid under centrifugation. An adapter in accordance with this aspect of the present invention may thus be used in a vertical angle centrifuge rotor without the necessity of a capping mechanism for the rotor cavity.

At least one of the adapter segments has an effective weight sufficient to balance forces created by the pressure of a liquid carried in the tubes under centrifugation that act transversely to the axis of the recesses. In use, with the adapter inserted into a cavity of a rotor, the one segment is disposed closer to the axis of rotation so that the mating surfaces of the adapter segments lie in a plane that is perpendicular to a radius of the rotor extending through the cavity. In such a disposition the weight of the one segment while under centrifugation is sufficient to maintain the mating surfaces of the adapter segments in contacting relationship with each other. Suitable keying may be provided to identify the one segment having the predetermined effective weight.

BRIEF DESCRIPTION OF THE DRAWINGS

The invention will be more fully understood from the following detailed description thereof, taken in connection with the accompanying drawings, which form a part of this application and in which.

DETAILED DESCRIPTION OF THE INVENTION

Figure 3:
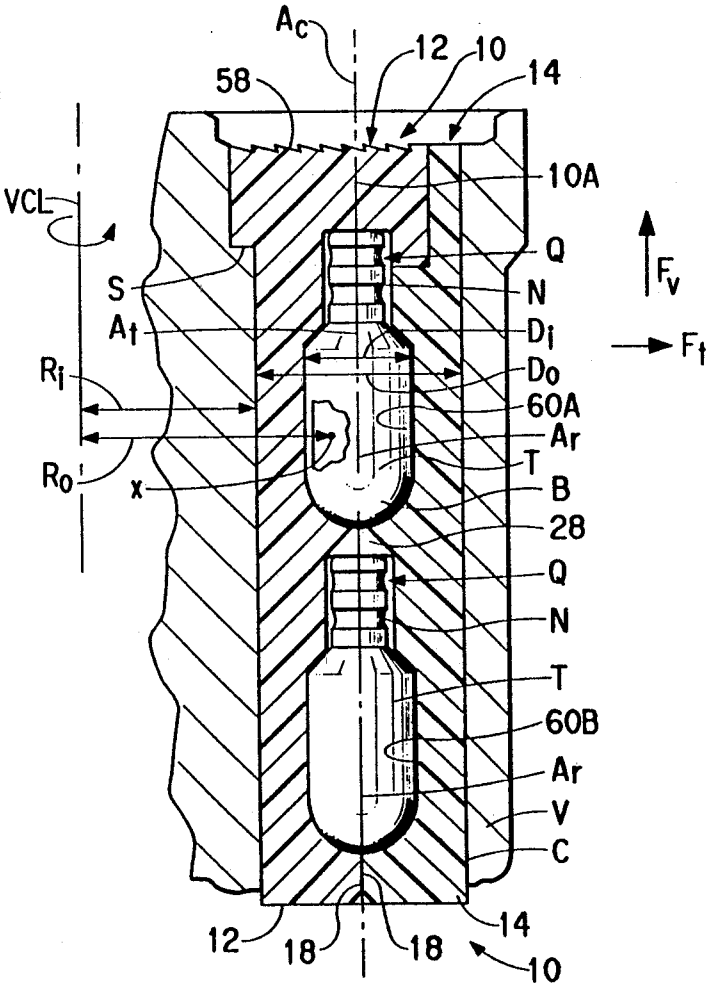
FIG. 3 is a side sectional view of an adapter formed from the mating adapter segments of FIGS. 1 and 2 in use within a single cavity of a vertical angle centrifuge rotor, the adapter supporting a pair of centrifuge tubes over their entire axial length within the cavity.

Throughout the following detailed description, similar reference numerals refer to similar elements in all Figures of the drawings.

Figure 2:
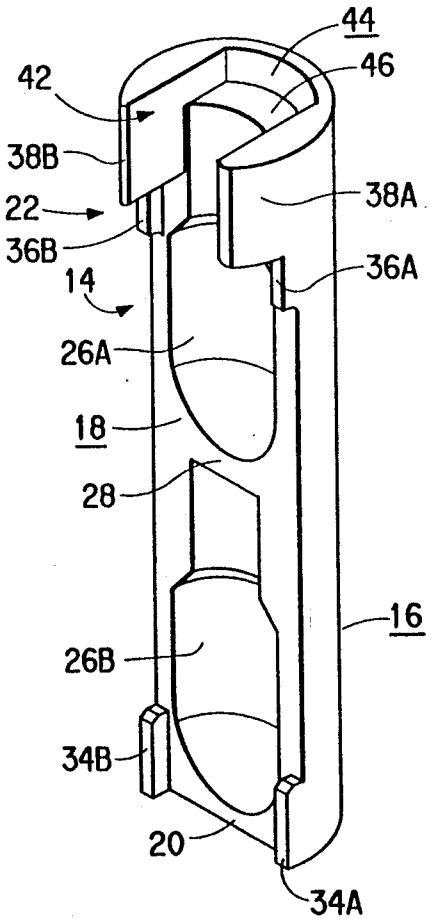
FIG. 2 is a perspective view looking radially outwardly of the radially outboard segment of an adapter according to the present invention.
Figure 1:
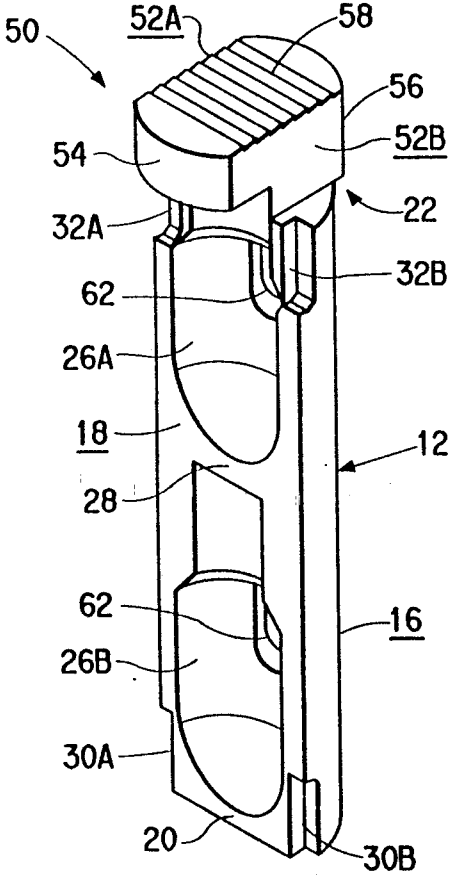
FIG. 1 is a perspective view looking radially inwardly of the radially inboard segment of an adapter according to the present invention.

FIGS. 1 and 2 are, respectively, perspective views of a first adapter segment 12 and a second adapter segment 14. For convenience the segment 12 is termed the "radially inboard" segment, while the segment 14 will be referred to as the "radially outboard" segment. As will be developed when the adapter is in use the inboard segment 12 lies closer to the axis of rotation VCL than does the outboard segment 14. When mated as shown in FIG. 3 the segments 12, 14 cooperate to define an adapter generally indicated by the reference character 10. The adapter 10 has a central axis 10A therethrough.

The adapter 10 supports a pair of centrifuge tubes T within the cavity C of a vertical angle centrifuge rotor V. The cavity C may be closed, if desired. The cavity C of the rotor V is open at its lower end and the lower end of the adapter 10 projects therethrough, as shown. The cavity C may be closed, if desired. The cavity has an axis $A_c$ therethrough. The axis $A_c$ aligns collinearly with the central axis 10A of the adapter 10 and in parallel relationship to an axis VCL about which the rotor V is rotatable. The rotor V has a shelf S formed therein. The shelf S communicates with the upper end of the cavity C.

Each of the tubes T has a body portion B with a closed end E. The body B tapers through a generally conical transition region to a narrowed neck region N. The mouth of the tube T serves as the port through which a liquid under test may be loaded into the tube T. When filled the tube T is capped by a suitable capping assembly Q. Preferably the capping assembly disclosed in U.S. Pat. No. 4,552,278 (Romanauskas) is used to cap the tube, so that the neck N of the tube has a corrugated configuration imparted thereto. Each tube T has an axis $A_t$ extending therethrough.

Each adapter segment 12, 14 has an exterior surface 16, a planar mating surface 18, a closed lower end region 20 and an upper end region 22. The major portion of the exterior surface 16 of each segment is generally cylindrical in shape. The adapter 10 formed when the segments 12, 14 are mated has a right circular cylindrical configuration over its length. The exterior of the lower end region 20 of the adapter segments 12, 14 is shown as planar, although it may be otherwise shaped, if desired, to conform to the shape of the closed lower end of the rotor cavity C.

The planar mating surface 18 of each of the adapter segments 12, 14 has a pair of indentations 26A, 26B therein. The indentations 26A, 26B in each segment 12, 14 correspond to the size and contour of a tube T. The indentations 26A, 26B in each segment 12, 14 are separated by a web portion 28.

Each lateral vertical edge of the planar mating surface 18 of one of the segments, e.g., the inboard segment 12, is provided adjacent both its lower end region 20 and its upper end region 22 with a pair of notches 30A, 30B and 32A, 32B, respectively. Corresponding locations on the lateral vertical edges of the mating surface 18 of the other segment, i.e., the outboard segment 14, carry respective pairs of tabs 34A, 34B and 36A, 36B.

A pair of arms 38A, 38B project from the upper end region 22 of one of the segments, e.g., the outboard segment 14, The confronting surfaces 40A, 40B on the respective arms 38A, 38B cooperate to define a channel 42. The end of the channel 40 is closed by a wall 44. The base of the wall 44 defines a planar shoulder 46 that lies above the upper end of the indentation 26A in that segment 14.

The upper end region 22 of the other segment, i.e., the inboard segment 12, is provided with a flange 50. The lateral surfaces 52A, 52B of the flange 50 are planar. The flange 50 extends past the mating surface 24 on the segment 12 and terminates in an end 54 that matches the shape of the wall 44. Overall the flange 50 is shaped to correspond to the shape of the channel 42 so as to be closely received thereby. A tab 56 is located on the flange 50 opposite the end 54 thereof. The tab 56 extends over the exterior surface 16 of the segment 12. The upper surface of the flange 50 has gripping serrations 58 provided thereon. The serrations 58 facilitate manipulations of the segments 12, 14 and serve as a useful visual indicator to identify the segment 12.

When the segments 12, 14 are facially mated along the mating surfaces 18 thereof an adapter 10 having a compact, cartridge-like structure is defined. Since the indentations 26A, 26B in each segment 12, 14 correspond in size and contour to a tube T, when the segments 12, 14 are mated corresponding indentations 26A, 26A in each segment cooperate to define a pair of recesses 60A, 60B (FIG. 3) that similarly correspond in size and shape so as to totally surround a centrifuge tube T (including the capped neck thereof) received therein.

Each recess 60A, 60B has an axis $A_r$ extending therethrogh. The axes $A_r$ of the recesses 60A, 60B are collinear. The collinear axes $A_r$ of the recesses are parallel to the axis of rotation VCL of the rotor, and are also preferably aligned collinearly with the axis 10-A of the adapter 10 and with the axis $A_c$ of the cavity C in which the adapter 10 is disposed.

The tube T received in the upper recess 60A is surrounded totally by the material of the inboard segment and the outboard segments, with the upper surface of the web 28 in each segment supporting the lower end of the tube. The undersurface of the flange 50 on the segment 12 overlies the top of the capping assembly Q of the upper tube T. A tube T received in the lower recess 60B is also surrounded totally by the material of the inboard and the outboard segments, with the lower surface of the web 28 overlying the top of the capping assembly Q of the lower tube T and the material of the lower end regions 20 of the segments 12, 14 supporting the lower end of the tube.

The tabs 34A, 34B and 36A, 36B and the respective notches 30A, 30B and 32A, 32B primarily perform an alignment function to assist in mating the segments 12, 14. However, depending upon the manufacturing tolerances, when mated the tabs 34A, 34B and 36A, 36B may incidentally frictionally engage the surfaces of the respective notches 30A, 30B and 32A, 32B. The flange 50 is received within the channel 42 and the surfaces 52A, 52A, depending upon the manufacturing tolerances, may also incidentally frictionally engage the surface 40A, 40B, respectively, on the upper end region 20 of the adapter 14. Although it is envisioned that the adapter segments 12, 14 be held together by an operator and inserted into the cavity C of the rotor V, the incidental frictional engagement of the tabs in the notches and the flange in the channel may cooperate to assist in holding together the segments defining the adapter 10.

As may also be seen in FIG. 3 when the adaptor 10 is received within the cavity C of the vertical rotor V the projecting tab 56 abuts against the shelf S that is formed about the mouth of the cavity C on the radially inboard side thereof.

The adapter 10 in accordance with the present invention is able to support a pair of closed tubes T in a vertical angle rotor V without the necessity of a separate capping arrangement to close the upper end of the cavity C. To this end the adapter 10 must exhibit sufficient strength to absorb the forces imposed on the tubes T by the pressure of the liquid therein. Thus, as the term is used herein, "sufficient strength" means that the adapter must be able to withstand the forces imposed on it during centrifugation without failing or deforming to the extent that the tube(s) carried therein rupture.

Whether a given adapter is of sufficient strength, and thus falls within the scope of the claim of the present application, can be determined from various readily ascertainable operating parameters of the vertical angle rotor V in which the adapter 10 is to be used and the application to which the adapter 10 is to be put. These parameters are the the radius $R_i$ (which represents the minimum distance to the sample from the axis A of rotation), the diameter $D_o$ of the rotor cavity, the thickness of the adapter segment, the inside diameter of the tube (all as illustrated in FIG. 3), the specific weight of the liquid sample within the tube(s), and the speed of rotation of the vertical angle rotor.

The pressure at any location across the diameter of a tube in which the liquid sample is disposed is $$P = \frac{\omega^2}{2g}\alpha(R_o^2 - R_i^2) \quad (1)$$

where

P is the pressure (psi), $\omega$ is the rotational velocity of the rotor (radians per second), g is acceleration due to gravity (inches per second$^2$), $\alpha$ is the specific weight of the sample (Lb per inch$^3$), $R_o$ is the distance to the point of interest x where the pressure value is desired from the center of rotation (inches), and $R_i$ is the minimum distance to the sample from the axis A of rotation (inches).

The total vertical force $F_V$ that the adapter must withstand is then found by integrating this pressure function over the circular cross sectional area of the inside of the tube.

Knowing the adapter dimensions and the force $F_V$, the average stress in the wall of the adapter can be determined in accordance with the relationship:

$$s = \frac{F_V}{(\pi/4)(D_o^2 - D_i^2)} \quad (2)$$

where s is the stress (psi), $F_V$ is the force (Lbf)

$D_o$ is the diameter of the rotor cavity, and $D_i$ is the inside diameter of the adapter when operating at speed, which equals the diameter of the rotor cavity minus the thickness of each of the segments of the adapter.

Based on the identity of the material used in the given adapter, the modulus of elasticity of that material may be readily obtained. An estimation of the vertical deformation of the adapter may be found by multiplying the initial length of the adapter by the average stress divided by the modulus of elasticity of the adapter material. If the average stress calculated in Equation (2) is less than the ultimate strength of the adapter material, and the predicted deformation is less than the deformation that will cause first leakage in the tube carried within the adapter, then the given adapter is to be construed to have sufficient strength for at least one operating cycle, and therefore falls within the contemplation of the present invention. The determination of sufficient strength as set forth above under operating conditions will verify both the analysis and the conclusion of the sufficiency of strength of the adapter.

In addition, in accordance with the present invention, the adapter 10 is designed and fabricated such that, under centrifugation, the body force of one adapter segment is sufficient to balance the force created by the pressure of a liquid carried in the tube(s) under centrifugation that acts transversely to the axis of the recesses in which the tubes are disposed. As will be developed, when in use the adapter must be disposed within a cavity C of a rotor in an orientation such that the mating surfaces 18 of the adapter segments 12, 14 lie in a plane that is substantially perpendicular to a radius of the rotor V extending through the cavity V. In FIG. 3 the plane under discussion extends out of the plane of the paper.

In accordance with the invention at least one of the segments of the adapter 10 must have a predetermined effective weight under centrifugation that is sufficient to prevent separation of the adapter segments. The effective weight of the adapter segment is defined as the weight of the segment at sea level multiplied by the g (gravity) force imposed on the segment when the same is rotated at a predetermined operating speed with the center of mass of the segment lying a predetermined radial distance from an axis of rotation.

When disposed in the rotor V the inboard segment 12 must have an effective weight sufficient to balance the force $F_T$ created by the pressure of a liquid carried in the tube(s) under centrifugation that acts transversely to the axis $A_r$ of the recesses of the adapter 10. Such an arrangement precludes separation of the adapter segments 12, 14 during centrifugation. When properly positioned in the cavity C of the rotor V the mating surfaces 18 of the adapter segments 12, 14 are disposed so as to lie in a plane that is substantially perpendicular to a radius of the rotor V extending through the cavity C. As noted, this plane is perpendicular to the plane of FIG. 3.

Whether the inboard adapter segment 12 has an effective weight sufficient for the purpose of containing the transverse force $F_T$, and thus fall within the scope of the claim of the present application, can be determined from consideration of the identical operating parameters as previously developed and described in connection with the "sufficient strength" determination for accommodation of the vertical force $F_V$.

As earlier noted the pressure P across the diameter of the tube is defined by Equation (1). The value of the pressure P ranges from zero at the inboard edge of the tube to a maximum value at the farthest radial location of the liquid sample from the axis of rotation of the rotor. The inboard segment 12 of the adapter 10 is subjected to a radially inwardly directed force $F_T$ that results from liquid pressure in the inboard half of the tube. The magnitude of this radially inwardly directed force $F_T$ is determined by integrating the component of the pressure function defined by Equation (1) that is parallel to a radial line through the center of mass of the inboard segment 12 over the surface area of the indentations 26A, 26B of the adapter segment 12. So long as the effective weight of the inboard segment 12 is equal to or greater than the force $F_T$ due to liquid pressure, then centrifugal force effects acting on the inboard segment 12 cause the mating surfaces 18 of the adapter segments 12, 14 to remain in contacting relationship. The adapter 10 will thus maintain complete containment of the tube(s) during operation of the rotor.

It should be understood that both the segments 12, 14 may be substantially identical in weight or they may be substantially different in weight, so long as the inboard adapter segment 12 has the requisite effective weight to completely contain the tube T during operation of the rotor.

By providing the inboard segment 12 having a suitable effective weight the mating surfaces on the inboard and outboard segments 12, 14 remain in contact during operation of the rotor and no gap therebetween may form. The tube(s) T are thus completely contained within the conjoined adapter segments during operation of the rotor, and the possibility of tube failure due to extrusion into a gap between segments is precluded. The present embodiment cames the additional benefit of minimizing circumferential stress in the tube caused by the pressure of the liquid, therefore further reducing the possibility of tube failure. Since the effective weight of the inboard segment of the adapter is at least as great as the transverse force due to pressure $F_T$, the inboard segment limits expansion of tube. Greater tube reliability over a greater range of tube, adapter and cavity tolerances is thus produced.

As previously mentioned, the adapter 10 must be disposed in the cavity C of the rotor V in an orientation in which the mating surfaces 18 of the adapter segments 12, 14 lie in a plane that is perpendicular to the radius of the rotor extending through the cavity C. To meet this need, the segments 12, 14 may be keyed in a fashion to be described. The keying can be implemented by providing any suitable distinctive physical feature on the adapter, such as a visually distinctive marking or a distinctive shape. In the present instance the keying is effected using the tab 56 and the shelf S in the rotor V.

If both segments 12, 14 have the requisite effective weight sufficient to ensure complete containment of the tube in the adapter recess then the keying feature is not required, and either segment may assume the position of the inboard segment. Thus, the adapter may be inserted into the cavity in either of two different orientations and the desired performance will occur (assuming the mating planes align with respect to the radius of the rotor, as described).

Should only one segment 12 exhibit the requisite effective weight then a form of keying is necessary which both: (1) identifies that segment as the inboard segment; and (2) aligns the mating surfaces 18 of the adapter segments 12, 14 in the plane.

An adapter in accordance with the present invention may be fabricated from any suitable material so long as the resulting adapter 10 has sufficient strength and so that at least the adapter segment 12 has sufficient effective weight (as those terms are defined herein). The material of choice must exhibit other desirable properties, such as appropriate ultimate strength, appropriate modulus of elasticity, suitable chemical compatibility with any liquid sample being centrifuged and ability to withstand sterilization, as by autoclaving. Suitable plastic materials include polypropylene, polyamide, acetal, polyphenylene oxide, polyvinyl choloride, polycarbonate or polyethylene. Other plastic or metallic materials (either homogeneous (neat) or fiber reinforced) with similar or better mechanical and chemical properties for the application under consideration may also be used. The adapter may be formed in any convenient manner consistent with the material selected, such as molding, machining, casting or forging. The segments 12 and 14 of the adapter 10 are in the preferred case fabricated, as by injection molding, from a material such as thirty percent carbon fiber reinforced polyphthalamide such as that sold by RTP Company, Winona, Minn. under product number RTP 4085.

In some instances the tubes T may be exposed, during centrifugation, to a load that causes a first portion of each tube to deflect radially outwardly and away from the inner surface of a first region of the inboard segment of the adapter while a second, adjacent, portion of the tube is forced into intimate contact with a second region of the the inner surface of the inboard segment of the adapter. To prevent the inboard segment of the adapter from undergoing radially outward deflections and attendant stresses that may limit the useful life of the adapter it is desirable to form openings 62 (shown only in FIG. 1) in the radially inboard segment 12 of the adapter. Preferably, the openings 62 are substantially coextensive with the first regions of the inboard portion of the adapter. By appropriately sizing the openings 62 substantially no part of the inboard segment 12 of the adapter is exposed during centrifugation to a load that exceeds the ability of the material of the adapter to support itself. Stated alternatively, the material of the inboard portion of the adapter surrounding the opening has sufficient strength to support itself while under centrifugation. The term "sufficient strength to support itself" as used in this context means that the adapter 10 is not likely to fail when used at a predetermined maximum operating speed over a predetermined useful lifetime of cyclic operation. The term "substantially coextensive" is meant to encompass an instance in which either more than or less than the entire first region of the inboard segment of the tube is removed. The intent is that by making the openings 62 substantially coextensive with the first regions of the inboard segment 12 the areas of relatively higher deflections and higher stresses are either eliminated or substantially reduced. An adapter having such an opening therein is claimed in copending application titled "Adapter For Centrifuge Tube", Ser. No. 08/068,498, filed contemporaneously herewith the names of Hall, Sheeran and Sullivan.

Those skilled in the art, having the benefit of the teachings of the present invention may impart numerous modifications thereto. It should be understood that such modifications are also to be construed to lie within the scope of the present invention, as defined by the appended claims.

What is claimed is:

1. An adapter for supporting a pair of closed centrifuge tubes within a cavity of a vertical angle centrifuge rotor for rotation about an axis of rotation, the adapter comprising:

a first, inboard, adapter segment and a second, outboard, adapter segment, each segment having an exterior surface and a mating surface thereon, each segment having a pair of indentations in the mating surface thereof, the indentations in each segment being shaped such that when the segments are joined along their mating surfaces the indentations cooperate to define a pair of recesses each able to totally surround a centrifuge tube disposed therein, each recess having an axis therethrough, the axes of the recesses being collinear and being parallel to the axis of rotation, the adapter segments being fabricated of a material that has sufficient strength to withstand vertical forces created by the pressure of a liquid in each tube while under centrifugation, at least the first, inboard, segment of the adapter having an effective weight sufficient to balance forces created by the pressure of a liquid carried in the tubes under centrifugation that act transversely to the axis of the recesses, so that, in use with the adapter inserted into a cavity of a rotor with the mating surfaces of the adapter segments being in contacting relationship with each other, the effective weight of the inboard segment while under centrifugation is sufficient to maintain the mating surfaces of the adapter segments in such contacting relationship.

* * * * *